US007804964B2

(12) United States Patent
Schreiber

(10) Patent No.: US 7,804,964 B2
(45) Date of Patent: Sep. 28, 2010

(54) DEVICE FOR PROTECTING THE HEARING FROM LOUD MRT SOUNDS

(75) Inventor: Axel Schreiber, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 1303 days.

(21) Appl. No.: 11/325,801

(22) Filed: Jan. 5, 2006

(65) Prior Publication Data

US 2006/0147070 A1 Jul. 6, 2006

(30) Foreign Application Priority Data

Jan. 5, 2005 (DE) ..... 10 2005 000 848

(51) Int. Cl.
*H04R 3/02* (2006.01)

(52) U.S. Cl. ..... 381/73.1; 381/72; 600/410; 600/418

(58) Field of Classification Search ..... 381/73.1, 381/72, 71.1–71.8, 56, 104, 107; 600/410, 600/418

See application file for complete search history.

(56) References Cited

U.S. PATENT DOCUMENTS

| | | | | |
|---|---|---|---|---|
| 5,313,945 | A * | 5/1994 | Friedlander | 600/410 |
| 5,427,102 | A * | 6/1995 | Shimode et al. | 600/410 |
| 5,577,504 | A * | 11/1996 | Salloway et al. | 600/410 |
| 5,990,680 | A * | 11/1999 | Mansfield | 324/318 |
| 6,463,316 | B1 * | 10/2002 | Brungart | 600/410 |
| 2005/0031141 | A1 * | 2/2005 | McCrackin et al. | 381/104 |

FOREIGN PATENT DOCUMENTS

DE 197 27 657 C1 1/1999

* cited by examiner

*Primary Examiner*—Vivian Chin
*Assistant Examiner*—Jason R Kurr

(57) ABSTRACT

Device for protecting the hearing from loud MRT sounds

Device for protecting the hearing from loud MRT sounds, with a protective sound generating device linked to the MRT electronics for generating a protective sound rising slowly in amplitude, increasing the impedance in the middle ear immediately before the onset of the loud MRT sound.

11 Claims, 1 Drawing Sheet

DEVICE FOR PROTECTING THE HEARING FROM LOUD MRT SOUNDS

CROSS REFERENCE TO RELATED APPLICATIONS

This application claims priority to the German Application No. 10 2005 000 848.8, filed Jan. 5, 2005 which is incorporated by reference herein in its entirety.

FIELD OF INVENTION

The invention relates to a device for generating protective to protect the hearing of a patient during an MRT examination.

BACKGROUND OF INVENTION

During rapid switching of the gradient coils of magnetic resonance tomographs (MRT) sounds occur which can be very loud (>100 dB). The sound pressure level can rise within a few milliseconds from background noise to the maximum sound pressure level so that a real knocking sound occurs. Such knocking sounds can occur in examinations of vertebrates with magnetic resonance tomography and spectroscopy and in examinations with transcranial magnetic stimulation. These sounds cannot just damage the hearing but can also alarm the person being examined and are very unpleasant for them.

The current widely-used methods attempt to reduce the maximum sound pressure level and do this by constructional sound deadening methods or via a smaller gradient load. Another way is to reduce the sound pressure level at the ear, for example with headphones or ear plugs. Methods for sound extinction in the vicinity of the ear using interference are hardly ever implemented on account of the strong magnetic fields and the restricted space available. Headphones or earplugs also have only a very limited protective function since the loud knocking sounds can be transmitted not only via the auditory canal but also via the cranial bone into the inner ear and can thus simply thus not be filtered out just like that. Constructional sound deadening methods such as a heavier encapsulation of the coils and leads have only proved effective to a limited extent and reducing the sound by imposing less of a load on the gradient coils results in lower quality imaging.

SUMMARY OF INVENTION

An objective of the invention is to create a device for protecting the hearing from loud MRT sounds, which, without constructional measures at the gradient system and without adversely affecting the image quality, results in a markedly effective lowering of the stress on the patient.

To achieve this object the invention provides for a protective sound generating device coupled to the MRT electronics for generating a protective sound which rises slowly in amplitude, increasing the impedance in the middle ear directly before the onset of the loud MRT sound.

The invention is based in this case on the knowledge that the hearing of vertebrates possesses mechanisms which at high sound pressure levels adapt the impedance of the hearing chain in the middle ear and modulate the transmission function to the sensory cells in the inner ear. In the middle ear the tensor tympani muscle and the musculus stapedius modify the movability of the small bones in the ear. The reflex arcs of these Middle Ear Reflexes (MER) pass via the cochlea to the nucleus cochlearis, further via the upper olive core and efferent via the core of the nervus facialis (musculus stapedius) and of the nervus trigeminus (musculus tensor tympani) into the brain stem. In the inner ear the outer hair cells are controlled efferently (neural circuit in the brain stem via the olivocochlear bundle) to modulate the sensitivity of the inner hair cells.

The MER increase the impedance of the middle ear on both sides if on one side or on both sides the acoustic stimuli above the threshold can be heard. For human beings the thresholds lie, with an individual variation, at around 75 db(A). The impedance increases, depending on the sound pressure of the stimulus, until a maximum attenuation of around 40 dB is reached. For humans the onset of the attenuation is between 100 and 200 ms after an above-threshold stimulus. If the sound pressure reduces, the impedance of the middle ear is adapted. If the stimulus falls below the threshold value, after around 250 ms the attenuation has been reduced to half. After 1 to 3 seconds no more attenuation is evident. The stimulus response is at its most marked in the frequency range between 1000 and 3000 Hz. These neurophysiological characteristics of hearing can be used to protect the hearing against damage by gradient sounds in MR examinations. Before the abrupt beginning of a pulse sequence, for a few hundred milliseconds, the patient/subject can be played an over—threshold but submaximally loud sound to trigger the neurophysiological protection mechanisms. For further measurement the change in the sound pressure level over time can be adapted to the neurophysiological circumstances.

In a development of the invention the protective sound generating device should be able to determine from the sequence design, that is from the known sequence of the control signals of a pulse sequence, the times of the occurrence of sudden loud gradient sounds, and generate the adapted protection sounds, offset in time from the gradient sound level to be expected in each case.

In the preparation of an MRT measurement the initial sound pressure level and the main frequencies of the sequence can be estimated in this case provided priority is not given to a true measurement or calculation by previous trial runs linked to a storage of the results which can be referenced by the protective sound generating. Before the actual measurement begins the hearing is then presented with a protective sound which triggers the neurophysiological protection mechanisms. The sound pressure level of the protection sound initially begins below the threshold at around 70 dB(A) at 2000 Hz. Within the next 200 to 400 ms, with the duration depending on the sound pressure level to be reached, the sound pressure level will be adapted linearly to the initial sound pressure level of the sequence. In the last 100 ms the frequency of the protective sound can also be adapted to the main frequencies of the sequence, so that the patients are not alarmed if the frequency spectrum of the sound changes suddenly at the beginning of the measurement.

In accordance with a further feature of the invention there can be provision in this case for the protective sound generating device, during a pulse sequence, by a continuous or discontinuous protective sound to prevent variations, especially a sharp reduction of the impedance in the middle ear, so that not only the knocking sound at the beginning of an MRT measurement but also all similarly loud gradient sounds occurring subsequently during the measurement are effectively attenuated via the protection mechanism of the ear.

For transmission of the protective sounds the protective sound generating device can be linked to loudspeakers or headphones for the patient, with the difficulty in the case of headphones being that they can frequently not easily be used for reasons of space, and account has to be taken in this case of the fact that these headphones also influence the transmission of the gradient sound, so it is necessary to take account of this attenuation effect accordingly.

The loudspeakers can be built into the wall of the patient chamber of the magnetic resonance tomograph, and a number loudspeakers should also be arranged in the examination room to protect the people working there.

As well as the option of generating protective sounds directly in the protective sound generating device, in accordance with a further feature of the present invention there can also be provision for the protective sound to be created with the gradient system, for example in such a way that, to create the protective sound for the examination and image recording currently being performed, gradient coils which are not needed are switched.

The protective sound can have an entertainment value, such as music for example. In this case the protective sound can be provided for the entire duration of the examination.

Particular conditions must be fulfilled to enable music to be used as protective sound: The music may not have any long-lasting (for music) changes in sound pressure level (e.g. no pauses with a reduction in the sound pressure level of 6 dB(A) which are longer than 100 ms). In particular pauses m ay not occur between individual tracks.

The average sound pressure level of the music being played is controlled as a function of the gradient sound to be expected: If no measurement is performed, the music is played at the volume set by the patient. Before a measurement the average sound pressure level is matched to the gradient sound to be expected, taking into account the description of a protective sound given above. Since the music is played constantly in any event, the phase of linear level matching can be selected to be longer. During a measurement the music is provided at a slightly higher (e.g. +2 dB (A)) sound pressure level.

BRIEF DESCRIPTION OF THE DRAWINGS

Further advantages, features and details of the invention are produced by the subsequent description of an exemplary embodiment as well as by reference to the drawings. The Figures show.

DETAILED DESCRIPTION OF INVENTION

Figure 1:
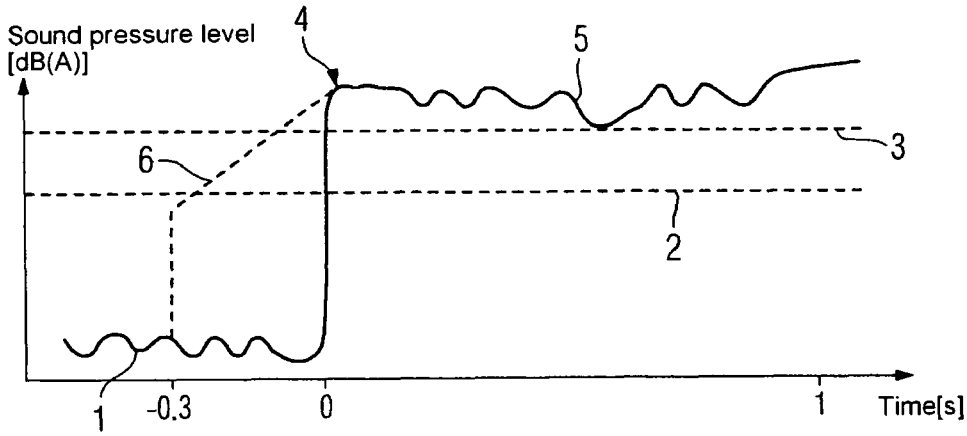
FIG. 1 a schematic diagram of the development of the sound pressure over time for an MR measurement measured at the outer auditory c anal and FIG. 2 a schematic diagram of the energy transmission to the inner ear.

In the diagram shown in FIG. 1 the sound pressure curve 1 indicates the background noise before the onset of the actual first knocking sound at time 0. The number 2 shows the reflex threshold of the ear and 3 the sound pressure level in excess of which there is a danger of damage to hearing. 4 is the initial sound pressure level and 5 indicates the sound pressure level at the outer auditory canal after this loud initial sound. 6 sketches in schematically the curve of the protective sound to be provided in accordance with the invention before the actual occurrence of the harmful gradient sound, that is before point in time 0.

Figure 2:
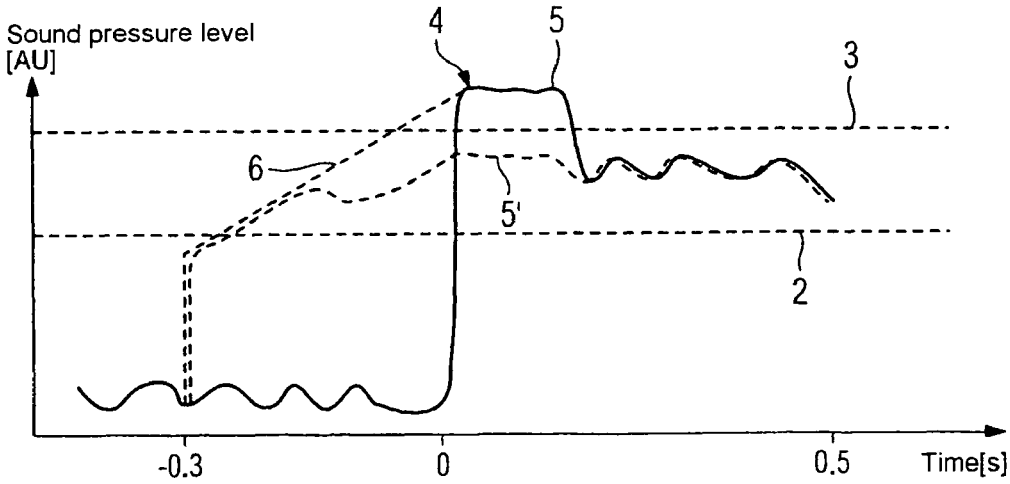

The protection function, via the protective sound 6 which increases the impedance of the inner ear before the occurrence of the loud gradient sound and thus moderates the initial sound pressure level for the patient, can be seen from FIG. 2. This diagram shows how the initial sound pressure level 4 and the subsequent high sound pressure level at the inner ear without protective sound, by using the protective sound before the actual loud gradient sound, which generates the initial sound pressure 4, is markedly reduced to a sound pressure curve 5' which lies below the hearing damage threshold 3. From the sound pressure level 5 at the inner ear without protective sound in FIG. 2, it can be seen that without a protective sound the neurophysiological protection measurements are not initiated until point in time 0 and thereby the impedance of the middle ear is not increased for a few hundred milliseconds.

With protective sound the increased sound pressure levels trigger the neurophysiological protection mechanisms appr. 300 ms before the measurement. If the measurement starts with the very high initial sound pressure, the impedance of the middle ear is already increased and the inner ear is protected.

The invention claimed is:

1. A device for protecting the hearing from loud magnetic resonance tomograph sounds, comprising:

a protective sound generating device coupled to magnetic resonance tomograph electronics of an magnetic resonance tomograph for creating a protective sound, the sound generating device configured to generate the protective sound having a slowly increasing amplitude, the protective sound configured to increase an impedance in the middle ear based on a Middle Ear Reflex (MER) of a patient undergoing examination using the magnetic resonance tomograph, wherein the sound generating device is further configured to generate the protective sound immediately before the loud magnetic resonance tomograph sounds set in when operating the magnetic resonance tomography, wherein the loud magnetic resonance tomograph sounds include an abruptly occurring loud gradient noise formed as a pulse sequence, and the protective sound generating device is further configured to:

determine the set in of the loud gradient noise using a known sequence of control signals of the pulse sequence; and generate the protective sound having a time offset and based on an expected gradient sound level.

2. The device in accordance with claim 1, wherein the protective sound generating device is further configured to generate the protective sound having a frequency spectrum adapted to a noise frequency spectrum of the gradient noise.

3. The device in accordance with claim 2, wherein the protective sound generating device adapts the frequency spectrum to the noise frequency spectrum in a time period immediately preceding the set in of the gradient noise.

4. The device in accordance with claim 1, wherein the loud MRT sounds include an abruptly occurring loud gradient noise formed as a pulse sequence, and the protective sound is a continuous or discontinuous protective sound configured to maintain the increased impedance in the middle ear while the pulse sequence occurs.

5. The device in accordance with claim 1, wherein the protective sound generating device is configured to be coupled to at least one loudspeaker or to headphones provided for emitting the protective sound.

6. The device in accordance with claim 5, wherein the loudspeaker is integrated into a wall of a patient chamber of the magnetic resonance tomograph.

7. Device in accordance with claim 5, comprising a plurality of loudspeakers arranged in an examination room for protecting people present in the examination room while operating the magnetic resonance tomograph.

8. The device in accordance with claim 1, wherein the protective sound is generated by a gradient system having a plurality of gradients of the magnetic resonance tomograph.

9. Device in accordance with claim 8, wherein the protective sound is generated by such gradients momentarily not required for examination and imaging during the examination of the patient.

10. The Device in accordance with claim 1, wherein the protective sound includes music.

11. The Device in accordance with claim 10, wherein the music is played back during a measuring sequence executed by the magnetic resonance tomograph.

* * * * *